United States Patent [19]

Gregoire et al.

[11] 4,047,711

[45] Sept. 13, 1977

[54] ADJUSTABLE MOUNTING FOR PAPER PLOW

[75] Inventors: Clyde G. Gregoire, Bensenville; James A. Hartman, Brookfield; Milton J. Gregoire, Lombard, all of Ill.

[73] Assignee: Gregg Engineering Corporation, Lyons, Ill.

[21] Appl. No.: 672,397

[22] Filed: Mar. 31, 1976

[51] Int. Cl.[2] ..... B65H 45/22

[52] U.S. Cl. ..... 270/86; 270/93; 93/20

[58] Field of Search ..... 270/86–93; 93/11, 84 R, 63 R, 84 TW, 59 MT, 17–20

[56] References Cited

U.S. PATENT DOCUMENTS

| | | | |
|---|---|---|---|
| 2,270,721 | 1/1942 | Westphal | 270/86 |
| 2,445,703 | 7/1948 | Williams | 93/20 X |
| 3,561,332 | 2/1971 | Ross | 93/19 |

*Primary Examiner*—J. Reed Fisher
*Assistant Examiner*—A. Heinz
*Attorney, Agent, or Firm*—Kenneth T. Snow

[57] ABSTRACT

A plow for use in a machine in the printing industry to provide for the folding of a paper web thereover. The plow through its novel mounting structure in the machine may be adjustably positioned relative to a frame support throughout a wide range of movements in all directions to accommodate any desired paper web travel through the machine. Adjustment of the plow position may be made while the paper web is moving through the machine to insure the proper and accurate guiding of the paper web through the machine.

9 Claims, 6 Drawing Figures

ADJUSTABLE MOUNTING FOR PAPER PLOW

BACKGROUND OF THE INVENTION

1. Field of the Invention

Fold over of paper webs in the printing industry has long been done but as stated in our earlier U.S. Pat. No. 3,799,536 on PAPER FOLDER the length of run necessary to effect such a fold over was substantial. In our earlier patent it was shown how the fold over process or the superimposing of one sheet of paper web over another was accomplished in just a few short feet. However, this foreshortening of the paper turning process has presented many more problems to the printer and to the machine operator. In earlier full bay turning the paper webs were given adequate space in which to self adjust when the paper turning plows were not accurately adjusted. Now with short space turning, accuracy of plow adjustment is extremely critical. Without this accurate adjustment of the plow the paper web easily becomes wrinkled either at the point of paper turn over or at the point of pulling of the paper between pinch rollers. It is not always good enough to accurately square the plow with the machine frame because the paper web itself may be out of square or may have some "camber" in it. Thus the present invention concerns itself with a fully and accurately adjustable paper plow.

2. Description of the Prior Art

In addition to the PAPER FOLDER U.S. Pat. No. 3,799,536 of Clyde G. Gregoire mentioned above, applicants call attention to the following prior art which would appear to have a bearing on the subject application.

The patent to Potdevin U.S. Pat. No. 1,975,121 entitled TUBE MAKING MACHINES shows and describes a laterally adjustable paper forming mechanism which permits the device to form various diameters of paper tubes.

The patent to Strain U.S. Pat. No. 1,982,703 entitled FORMER FOR PRINTING MACHINES shows and describes a device for folding paper upon itself in a printing machine. The Strain device includes a nose folder which is mechanically laterally adjustable and further is itself inherently elastic, flexible and yielding so that it is automatically self adjustable to prevent the buckling of the paper web being folded.

Hitner U.S. Pat. No. 2,204,274 entitled WAX PAPER FOLDING MACHINE illustrates a thin forming plate 42 acting in conjunction with deflecting and pressure rollers to accomplish a fold over of a paper web. Although this Hitner device shows the environment it lacks any disclosure of an adjustable paper plow.

The Haas et al U.S. Pat. No. 2,660,219 entitled HEAT-SEALING MACHINE shows and describes a paper former which is laterally and vertically adjustable. Flexibly mounted pressure rollers are adjustable and combine with the adjustable former to fold the paper web over upon itself. Despite the fact the Haas et al paper former is somewhat adjustable it is so rigid in many respects that it cannot be adjusted to compensate for irregularities in the paper web being folded.

SUMMARY OF THE INVENTION

A principal object of this invention is to provide a novel paper folder for use in printing industry machines.

An important object of this invention is to provide a novel adjustable mounting mechanism for paper plows to facilitate paper web turn over in printing machines.

Another important object of this invention is the provision of a device as defined in the preceding object and further having the plow capable of a compensating type of adjustment to guide and direct a paper web through the machine with little or no misalignment or wrinkling of that paper web.

Another and further important object and advantage of this invention is to provide a universally adjustable paper plow between the fixed side frames of a printing machine whereby movement of a paper web through that machine may be accurately guided for turning or deflecting without buckling or misaligning the paper regardless of the space allotted to the paper for its turning or deflecting.

Still another important object of this invention is to provide a novel plow having a relatively flat thin piece of metal having an upturned end in a circular arc and the plow pivotally mounted on a support on the center line of the circular arc of the upturned portion whereby the plow may be rockably adjusted about that center line as an axis.

Another and still further important object and advantage of the adjustable plow of this invention is the novel feature of being able to adjust the position of the plow while the paper web continues to run through the machine and thus irregularities of travel of the paper web may be conveniently worked out to a very fine degree while the paper web continues to run.

Other and further important objects and advantages of this invention will become apparent from the following description and accompanying drawings.

IN THE DRAWINGS

AS SHOWN IN THE DRAWINGS

Figure 1:
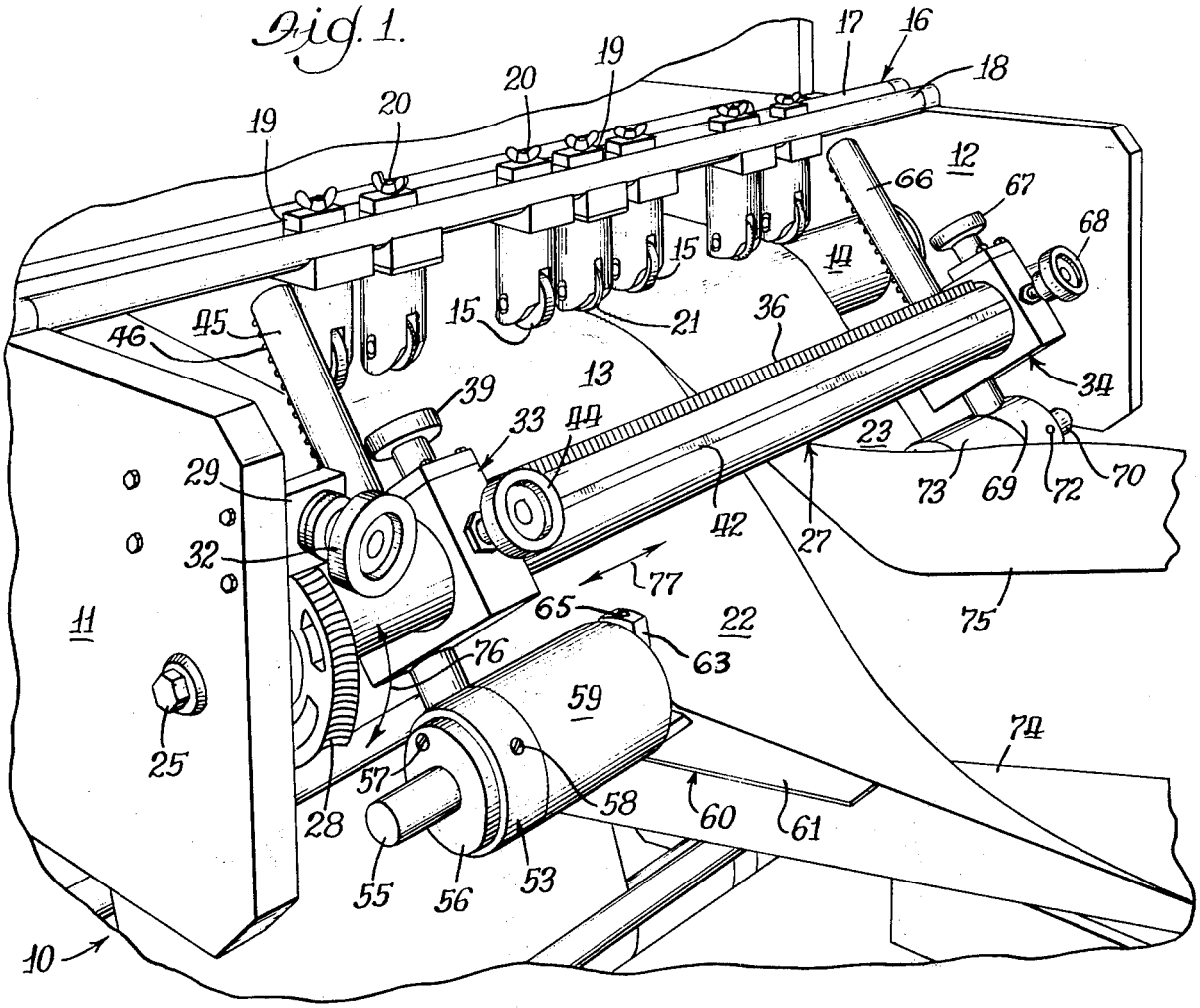
FIG. 1 is a perspective view of a portion of a machine used in the printing industry and including the adjustable mounting for the paper plow of this invention.

The reference numeral 10 indicates generally a printing machine such as presently used in the printing industry. The present invention is concerned only with that portion of such a machine that cuts, turns over and/or folds the paper web passing through such a printing machine. Usually the cutting and folding over of the paper web is done after the actual printing is accomplished.

The printing machine 10 includes a stationary side frame member 11 and a spaced apart side frame member 12. It is between these stationary side frame members that the paper web is printed and subsequently handled. A paper web 13 of substantially the full width of the machine as defined by the spaced apart stationary side walls 11 and 12 is pulled longitudinally through the machine 10. As viewed in FIG. 1 the paper web moves from the left end and toward the right end.

A large diametered roller 14 is journally carried in the spaced apart side walls 11 and 12 and it is over this roller that the paper web is pulled. This pulling is preferably accomplished by cooperative web engaging rollers (not shown) but similar to those rolls shown in the earlier patent to Gregoire U.S. Pat. No. 3,799,536. A plurality of small rollers 15 are adapted to apply an adjustable pressure on the top surface of the paper web 13 and against the under roller 14. A transversely disposed track member 16 comprises closely spaced apart parallel rod members 17 and 18. It is on this track that the pressure rollers 15 are adjustably carried and may be positioned to accomplish ease of travel of the paper web through the printing machine. Slide members 19 are associated with each of the small rollers 15 and are arranged and constructed to cooperate with the track 16. Thumb adjusting screws 20 cooperate with the slide members 19 and are used to lock the rollers 15 in their adjusted positions on the track 16.

In addition to the paper pressing rollers 15 there is included a knife roller 21 which in this instance is located in the center of the machine on the track 16. As shown in FIG. 1 the knife roller 21 severs the web 13 into halves so there are now two strips of paper 22 and 23 as the web is pulled toward the right or the discharge end of the machine.

A transversely positioned shaft 24 is mounted on and carried between the side frame members 11 and 12 at a location in the printing machine slightly forwardly of the cooperative rollers 14 and 15 and including the knife slitting roller 21. A nut 25 is threaded on one end of the shaft 24 and bears against the outer side of the side frame member 11. A similar nut 26 is threaded on the other end of the shaft 24 and bears against the outer surface of the other side wall 12 of the printing machine 10. A sleeve 27 is journally carried on the stationary shaft 24 between the side walls 11 and 12 and it is this sleeve that constitutes the transverse beam of this invention to which the plow mounting elements are adjustably carried.

Figure 6:
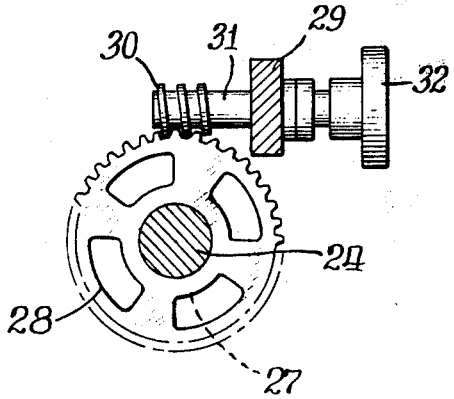
FIG. 6 is a detail sectional view taken on the line 6—6 of FIG. 2 showing the worm and gear drive employed to effect a rocking movement of the paper plow mounting of this invention.

A worm gear 28 is journally mounted on the shaft 24 and is fixedly attached to the sleeve beam 27. A stationary supporting member 29 is integral with or fastened to the side frame member 11 and projects inwardly therefrom toward the other side frame member 12. A worm 30 cooperates with the worm gear 28 in meshing engagement. The worm is mounted on a shaft 31 which is journally carried in the stationary supporting member 29 as best shown in FIG. 6. A wheel 32 is mounted on the outer end of the shaft 31 to effect a turning of the worm 30. It is preferred that this wheel be operated by hand but it should be understood that the wheel could be power rotated and accomplish the same result of rocking or tilting the sleeve beam 27 about the inner supporting shaft 24.

Figure 3:
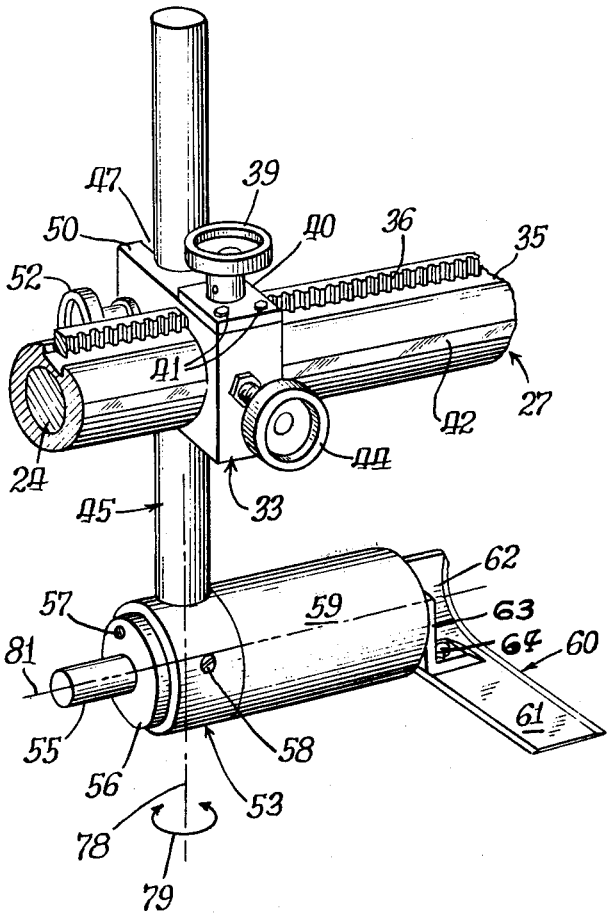
FIG. 3 is an enlarged perspective view detail of the paper plow and its adjustable mounting.
Figure 4:
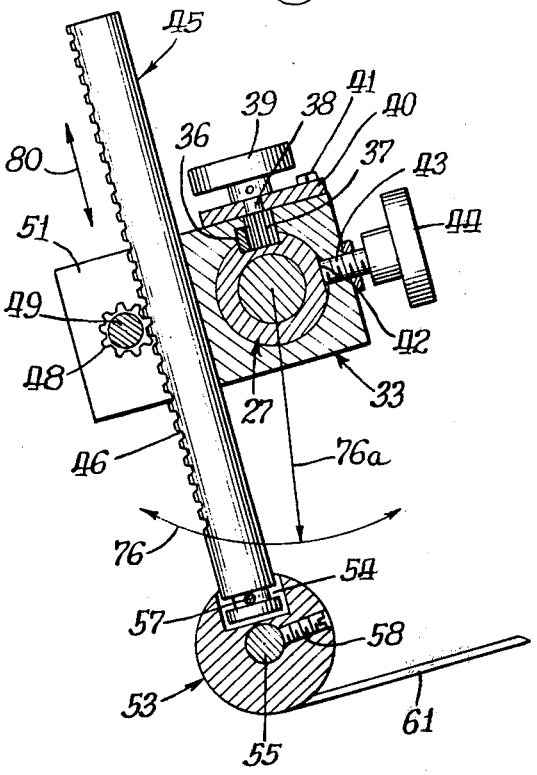
FIG. 4 is a sectional view of the paper plow and its adjustable mounting as taken on the line 4–4 of FIG. 2.

A support member 33 in the form of a rectangularly shaped block is transversely adjustable in the machine 10 along the sleeve beam 27. A similar block shaped support member 34 is carried on this sleeve beam 27 at a spaced apart position from the block 33. And, it should be understood that any number of such block supports may be used to accomplish the carrying of any desired number of paper plows to fold over or turn the path of travel of a paper web regardless of the number of strips in which it may be divided. A transversely disposed surface groove 35 is cut into and extends along the top surface of the sleeve beam 27 as best shown in FIG. 3. A gear rack 36 is affixed to the sleeve beam 27 within the surface groove 35 and is positioned at the back thereof with the gear teeth projecting forwardly. A spur gear 37 meshingly engages the gear rack 36 as shown in FIG. 4 and it is by this means that the rectangularly shaped block support member 33 may be adjustably positioned along the sleeve beam 27. The spur gear is mounted on a shaft 38 and is provided with a wheel 39 at the top thereof. The wheel 39 is shown as a hand wheel but may, as stated for the wheel 32, be power operated to cause the spur gear and its carrying block 33 to be moved along the gear rack 36 on the sleeve beam 27. A plate 40 is fastened by means of cap screws 41 to the top of the block support 33. It is this plate that constitutes the journal support for the shaft 38. A flat 42 in the form of a strip is provided across the front of the sleeve beam 27. A set screw 43 is threadedly engaged in the front wall of the block 33 and is adapted to engage the flat 42 to facilitate the holding of the block 33 in its adjusted position axially along the beam 27. A hand wheel is provided on the outer end of the set screw 43 to facilitate the turning of the set screw in its tightening or loosening.

A plow supporting arm or post 45 in the form of a cylindrical rod is carried in the block support 33 in a generally vertical position within the machine 10. However, as will be subsequently seen the post may be inclined to any desired angle to facilitate the carrying of a paper plow in any desired location within the printing machine. A gear rack 46 is attached to and forms a part of the back side of the post 45. The gear rack extends lengthwise of the post 45. The block support 33 is provided with an open notch or slot 47 in the back thereof to receive the passage of the post 45. A spur gear 48 is mounted on a shaft 49 which is journally carried in spaced apart portions 50 and 51 of the block 33 flanking the sides of the slot 47. A hand wheel 52 is affixed to an outer end extension of the shaft 49 and provides the means to turn the spur gear which by meshing with the gear teeth on the rack 46 effects a raising or lowering of the plow supporting post relative to the block support 33.

A cylindrical member 53 constituting a right angle mount receives the lower end of the post 45 radially therein as shown in all of FIGS. 1, 2, 3 and 4. The lower portion of the post 45 which enters the cylindrical member 53 is provided with an annular groove 54 as best shown in FIG. 4. A transversely disposed shaft 55 passes through the axis of the cylindrical member 53 at a position beneath the terminal ending of the post 45 so there is no conflict between the post 45 and the shaft 55. An end cap 56 is mounted on the shaft 55 and abuts the outer end of the cylindrical member 53. An axially extending set screw 57 threadedly engages the cap 56 and enters into the cylindrical member 53 and thence into the annular groove 54 in the lower end of the post 45 to thus hold the post from separating from the cylindrical member 53. When the set screw is in the groove 54 but not yet bottomed out, the cylindrical member may be rotated about the post 45 as an axis. However, when the set screw 57 is tightened it causes the cylindrical member 53 to be fixed in its relationship with the post 45. A radially disposed set screw 58 located in the front of the cylindrical member 53 projects inwardly for abutting engagement with the transverse shaft 55 to thus hold the cylindrical member in desired adjusted position along the length of the shaft 55.

A cylindrical paper roller 59 is journalled for easy free rotation on the shaft 55 and is positioned in abutting relationship with the cylindrical member 53 on the side thereof opposite the end cap 56. This freely rotating roller 59 permits the paper web to ride on the underside with minimal or no friction.

A paper plow is designated generally by the numeral 60 and includes a flat rectangular portion 61 and an upwardly arcuately curved end 62. The center of the curve 62 is coincident with the axis of the shaft 55. The plow further includes a bracket 63 which is fastened thereto by means of bolts or the like 64. The bracket 63 projects upwardly from the flat portion 61 at substantially the position of the juncture with the curved portion 62. The bracket has a hole therethrough constituting a journal mount for the plow 60 to the shaft 55. A radially disposed set screw 65 threadedly engages the upper end of the bracket 63 and projects downwardly for engagement with the outer surface of the shaft 55. When this set screw is drawn up tightly the plow is locked in its angularly adjusted relationship with the shaft 55.

A second plow supporting post 66 engages the spaced apart support block 34 in a generally vertical position comparable to the post 45. Of course, this post 66 will also be tilted when the sleeve beam 27 is rotated by the worm and worm gear mechanism previously described. A hand wheel 67 similar to the hand wheel 39 is provided on top of the block 34 and effects transverse adjustment of the block 34 on the sleeve arm or beam 27. Following the adjustment of the support block 34 by rotation of the hand wheel 67 a front positioned hand wheel 68 similar to the hand wheel 44 operates a set screw to engage the flat 42 on the beam 27 to effect a locking of the block 34 in its desired fixed position. A cylindrical right angle mount 69 is provided at the lower end of the post 66. The mount 69 is equipped with a transverse shaft 70 similar to the shaft 55 on the mount 53. An end cap 71 abuts the outer side of the cylindrical mount 69. A set screw 72 threadedly engages the right angle mount 69 and acts to hold the mount to the shaft 70 when the screw is drawn up tightly. A paper roller 73 is freely journalled on the shaft 70 and it is this roller that carries on its undersurface the paper web 23.

The paper web strip 22 is folded at 74 over the plow 60. The paper web strip 23 is folded at 75 over a plow (not shown) located on the inner end of the shaft 70. The plow which is not shown is identical to the plow 60. The present invention is utilized to facilitate the easy uninterrupted flow of paper webs through a printing machine. It should be understood that such smooth flow is not always accomplished by technically accurate positioning of the various elements over which the paper web moves and is guided in its turns. This is true because the paper webs are not always accurate in themselves, and because of these variations in the paper the present device provides the capability of universally adjusting all the paper guiding rollers and plows to exactly fit the actual paper web and this is done while the paper web is moving through the machine. "Tracking" of the web is thus made easy and the result is no wrinkling of the paper web or any binding or edge curling of the paper web. Rather, perfect feeding and movement of the web through the printing machine is accomplished.

THE OPERATION OF THE DEVICE

The paper web 13 is preprinted in an earlier stage of the printing machine and delivered to the position as shown in FIG. 1 coming over the large diametered roller 14. The small pressure rollers 15 are spaced along the track 16 in strategic positions to gain the most control over the paper web. Cutting rollers and/or perforators may be used along this same transverse track 16 to either slit or perforate the travelling paper web. In this instance it is desired to sever the web into two half strip portions and to accomplish this the cutting roller 21 is located in substantially the center of the track 16. In the cutting of the web at this point the under roller 14 acts as a rolling anvil. Following the slitting of the web it is desired to fold over the two half web strips so at this position in the machine there will be two overlaid printed strips of the paper web. The folding over of the web strips is accomplished by the paper plows 60. To get the paper strips to fold over without tearing or wrinkling requires that the plows be positioned "just right." This "just right" positioning is obtained in this invention by a plurality of adjustable mechanisms as previously described.

The transverse beam 27 is rockably adjusted as shown by the two ended arcuate arrow 76 in both of FIGS. 1 and 4. The sleeve beam is rocked about its inner supporting shaft 24 when the worm 30 meshing with the worm gear 28 is rotated by the hand wheel 32. As the beam 27 carries the plow supporting posts 45 and 66 through their block support members 33 and 34 the rocking of the beam 27 causes comparable rocking of the blocks 33 and 34 and thus an angular tilting of the posts 45 and 46. Such swinging movement of the posts effects a movement of the web engaging plows 60 as will be evident in FIGS. 1, 3 and 4. FIG. 4 shows a radius *76a* extending from the axial center of the beam 27 to the two ended arcuate arrow 76.

Figure 2:
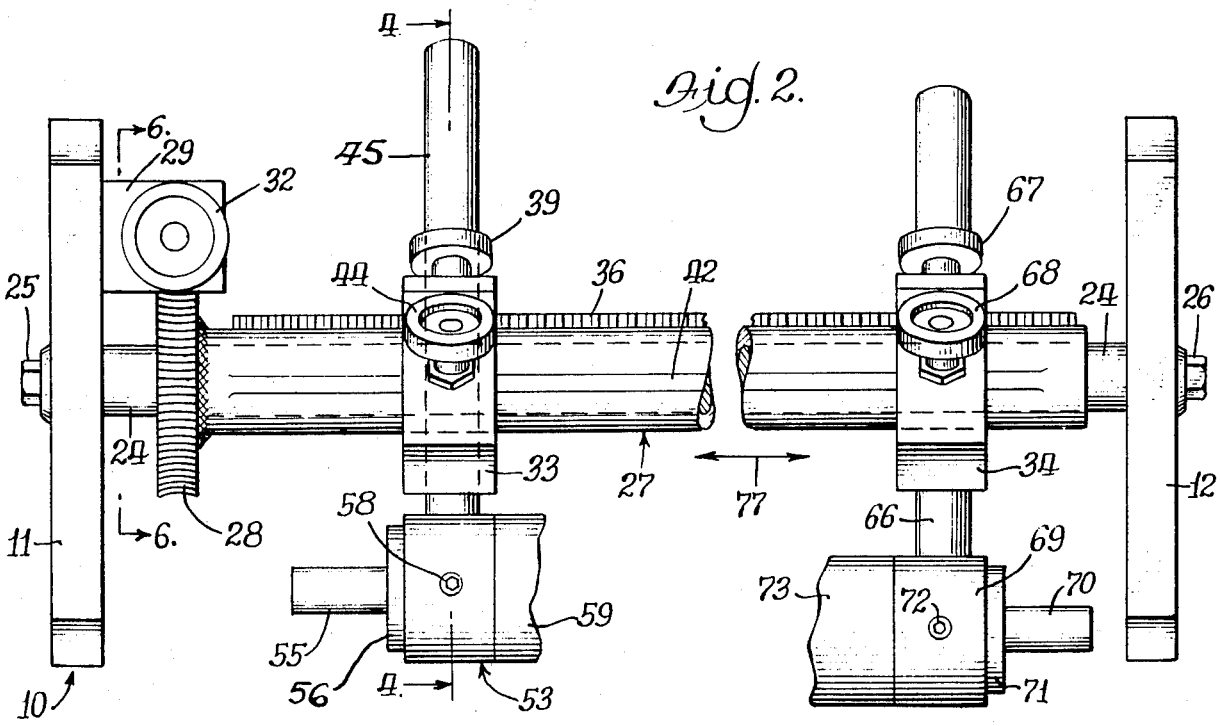
FIG. 2 is an enlarged front elevational view of the adjustable mounting for the paper plow with portions thereof broken away.

Two ended arrows 77 as shown in FIGS. 1 and 2 indicate the direction of movement for transverse adjustability of the blocks 33 and 34 on the beam 27 when the spur gears, actuated by the hand wheels 39 and 67, effect movement of the blocks along the gear rack 36. Such transverse movement of the paper plows 60 permits the user to have variable amounts of fold over of the paper web strips.

As best shown in FIG. 3 an axis 78 is shown for the post 45. A two ended arcuate arrow 79 indicates the arcuate swingability of the shaft 55 about the post axis as a center. Thus the paper roller 59 and the paper plow 60 may be accurately moved to accommodate variations in the paper web and have that web move smoothly through the printing machine. And, there is no reason why this and the other adjustments cannot be made when the web is moving through the printing machine. Actually adjustment is made much easier because of the paper web movement. One can readily adjust the position of the plow quite accurately to cause the web to properly "track" within the printing machine without causing any wrinkling or edge curling of the paper web. There is a tremendous advantage in adjusting a moving web over attempting to adjust the mechanisms with a non-moving or static web.

As best shown in FIG. 4 a two ended arrow 80 indicates the up and down movement of the post or rod 45 by reason of the cooperation of the spur gear with the gear rack 46.

Figure 5:
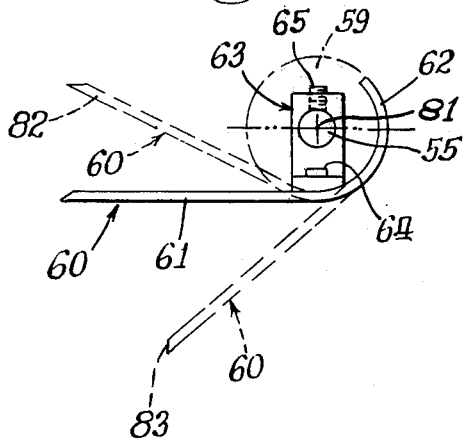
FIG. 5 is a side elevational view of the specific paper plow as used in the device of this invention.

Finally, the paper web plow 60 is arcuately adjustable about the axis 81 of the shaft 55 as best shown in FIGS. 3 and 5. One of the major reasons for the success of the present invention is that the curved end 62 of the plow 60 is concentric with and forms a continuation from the paper roller 59. As best shown in FIG. 5 the plow is depicted in an upwardly swung dash line position 82 and a downwardly swung dash line position 83 and in both instances the curved forward end 62 continues to be in the same circle as the outer circumference of the paper roller 59. The roller 59 and the curved portion 62 thus combine to form an uninterrupted smooth surface over which the paper web may be conveniently pulled without distorting the paper or impairing its fold over as desired.

It is apparent from the adjustments available to the user of this printing machine that the paper plow may be set to accommodate and fold or turn over a paper web in any desired manner. It is this universal adjustability that renders this machine so superior to any machine previously available in the printing industry.

We are aware that numerous details of construction may be varied throughout a wide range without departing from the principles disclosed herein and we therefore do not propose limiting the patent granted hereon otherwise than as necessitated by the appended claims.

What is claimed is:

1. A paper plow support for printing industry machines comprising spaced apart stationary side frame members, a transverse beam journally mounted for rockable movement in said stationary side frame members, means interposed between said beam and at least one of said side frame members for adjustably rocking said beam, a support member carried on said beam, means adjustably positioning said support member axially along said beam between said side frame members, means locking said support member in its adjusted position, a post, means moving said post relative to said support member at generally right angles to the axis of said beam, a cylindrical member mounted on and carried on one end of said post with the post disposed radially inwardly of said cylindrical member a limited distance, means locking said cylindrical member in any desired arcuately swung position about a longitudinal axis of said radially disposed post, a shaft mounted in and through the axial center of said cylindrical member and disposed at right angles to said radially disposed post, a cylindrical paper roller mounted on said shaft and abutting one end of the cylindrical member, and a plow having a flat portion and an arcuately upturned circular end, said arcuately upturned circular end having substantially the same diameter as the cylindrical paper roller and having its center coaxial with the axis of said shaft carrying said cylindrical paper roller, and means locking said plow in any desired rocked position about the axis of said shaft.

2. A device as set forth in claim 1 in which said means interposed between said beam and at least one of said side frame members comprises a worm gear affixed to said beam, a worm carried on said side frame member and cooperating with said worm gear, and a driving wheel mounted on said worm whereby the turning of said driving wheel causes the worm to rotate the worm gear which directly rocks the beam.

3. A device as set forth in claim 1 in which said means adjustably positioning said support member axially along said beam comprises said beam having a transversely extending groove in the surface thereof, a gear rack fixedly mounted in the groove of said beam, a spur gear journally carried in said support member and meshingly engaged with said gear rack, a drive wheel affixed to said spur gear whereby rotation of said drive wheel causes movement of said support member along said beam.

4. A device as set forth in claim 3 in which said means locking said support member in its adjusted position comprises said beam having a transversely extending flat on the surface thereof, a set screw threadedly engaging said support member and arranged to abuttingly engage the flat on said beam.

5. A device as set forth in claim 1 in which said means moving said post relative to said support member comprises a gear rack on said post, a spur gear supported on said support member and arranged and constructed to meshingly engage the gear rack on said post.

6. A device as set forth in claim 1 in which said means locking said cylindrical member in any arcuately swung position about a longitudinal axis of said radially disposed post comprises a set screw threadedly engaging said cylindrical member and arranged to abuttingly engage said post.

7. A device as set forth in claim 1 in which said means locking said plow in any desired rocked position about the axis of the shaft comprises a set screw threadedly engaging said plow and arranged and constructed to abuttingly engage said shaft which is supported in said cylindrical member and journally carries said paper roller.

8. A plow for paper webs comprising a relatively thin piece of material having a generally rectangularly shaped flat portion defining oppositely disposed narrow ends and an arcuate circular portion upturned from one of said narrow ends of said rectangularly shaped flat portion and the flat and circular portions jointly forming a smooth undersurface, said arcuate circular portion having an extent at least one-quarter of the arc of an entire circle about an axial center of said arcuate circular portion, a bracket affixed to said flat portion and extending upwardly in the same direction as the upturned arcuate portion, said bracket having a pivot center located on the axial center of the arcuate circular portion of the plow, a shaft having its axis on the axial center of the arcuate circular portion of said plow, said bracket adapted for journal mounting on its pivot center about said shaft, and means adjustably positioning said plow about said pivot center.

9. A device as set forth in claim 8 in which there is included a set screw threadedly engaging said bracket and adapted to hold said plow in any arcuate position relative to said shaft.

* * * * *